US010005649B2

(12) United States Patent
Liu

(10) Patent No.: US 10,005,649 B2
(45) Date of Patent: Jun. 26, 2018

(54) WORKSTATION WITH CONFIGURABLE LEAVES

(71) Applicant: Yiang-Chou Liu, Taipei (TW)

(72) Inventor: Yiang-Chou Liu, Taipei (TW)

( * ) Notice: Subject to any disclaimer, the term of this patent is extended or adjusted under 35 U.S.C. 154(b) by 132 days.

(21) Appl. No.: 14/822,856

(22) Filed: Aug. 10, 2015

(65) Prior Publication Data

US 2015/0368077 A1 Dec. 24, 2015

Related U.S. Application Data

(63) Continuation-in-part of application No. 13/295,087, filed on Nov. 13, 2011, now Pat. No. 9,138,889.

(51) Int. Cl.

| | |
|---|---|
| ***B66F 5/00*** | (2006.01) |
| ***B66F 7/28*** | (2006.01) |
| ***B25H 1/00*** | (2006.01) |

(52) U.S. Cl.

CPC ..... *B66F 7/28* (2013.01); *B25H 1/0007* (2013.01)

(58) Field of Classification Search

CPC ..... B66F 5/00; B66F 5/02; B66F 7/00; B66F 7/122; B66F 7/243; B66F 2700/05

See application file for complete search history.

(56) References Cited

U.S. PATENT DOCUMENTS

| | | | | |
|---|---|---|---|---|
| 4,010,942 | A * | 3/1977 | Ward | B25H 1/0007 269/15 |
| 4,640,495 | A * | 2/1987 | Parsons | B66F 5/04 254/134 |
| 7,975,986 | B2 * | 7/2011 | Bhachu | B66F 3/35 254/93 HP |
| 9,138,889 | B2 * | 9/2015 | Liu | B25H 1/0007 |
| 2002/0062686 | A1 * | 5/2002 | Keaton | B60P 1/4421 73/116.01 |
| 2013/0119594 | A1 * | 5/2013 | Liu | B66F 7/28 269/15 |
| 2015/0368077 | A1 * | 12/2015 | Liu | B66F 7/28 187/216 |

* cited by examiner

*Primary Examiner* — Lee D Wilson

(57) ABSTRACT

A workstation with configurable leaves suitable for repairing or maintaining auto mobiles is disclosed. The workstation includes a main board and a supporting module. The supporting module supports the workstation and provides an adjustable height for the workstation. The main board further includes at least two corresponding loading boards and a plurality of horizontal rods placed through the loading boards.

3 Claims, 7 Drawing Sheets

WORKSTATION WITH CONFIGURABLE LEAVES

BACKGROUND OF THE INVENTION

1. Field of the Invention

The present invention relates to a collapsible stand, and more particularly to a collapsible workstation stand for automobiles.

2. Description of Prior Art

Recently, the development of vehicle models are increasingly diverse, there are four-wheel vehicles, tricycles including one single front wheel with two rear wheels type or two front wheels with one single rear wheel type. However, as shown in FIG. 1, a conventional workstation table 2 has two loading boards 22, 22' co thined with a main board 20 and is only suitable for four wheeled vehicles maintenance. For three-wheeled type of vehicles, the loading board 22,22' will keep the maintenance personnel away from vehicles which causes difficulties and inconveniences for maintenance.

Therefore, it is desirable to provide a collapsible stand to mitigate and/or obviate the aforementioned problems.

SUMMARY OF THE INVENTION

In order to achieve the above-mentioned objective, in an embodiment of present invention, the loading boards mounted at the two sides of the workstation respectively can be break into two sections, which can be suitable for the two front wheels-one single rear wheel type and the one single front wheel-two rear wheels type. With the easy assembly of the front loading board or the rear loading board the technicians can work on different type of vehicles easily.

In another embodiment of the present invention, the loading boards of the main board respectively include a front loading board, a rear loading board and a middle loading board. Therefore, the technicians can have various accesses for different type of vehicles.

DETAILED DESCRIPTION OF THE INVENTION

Figure 1:
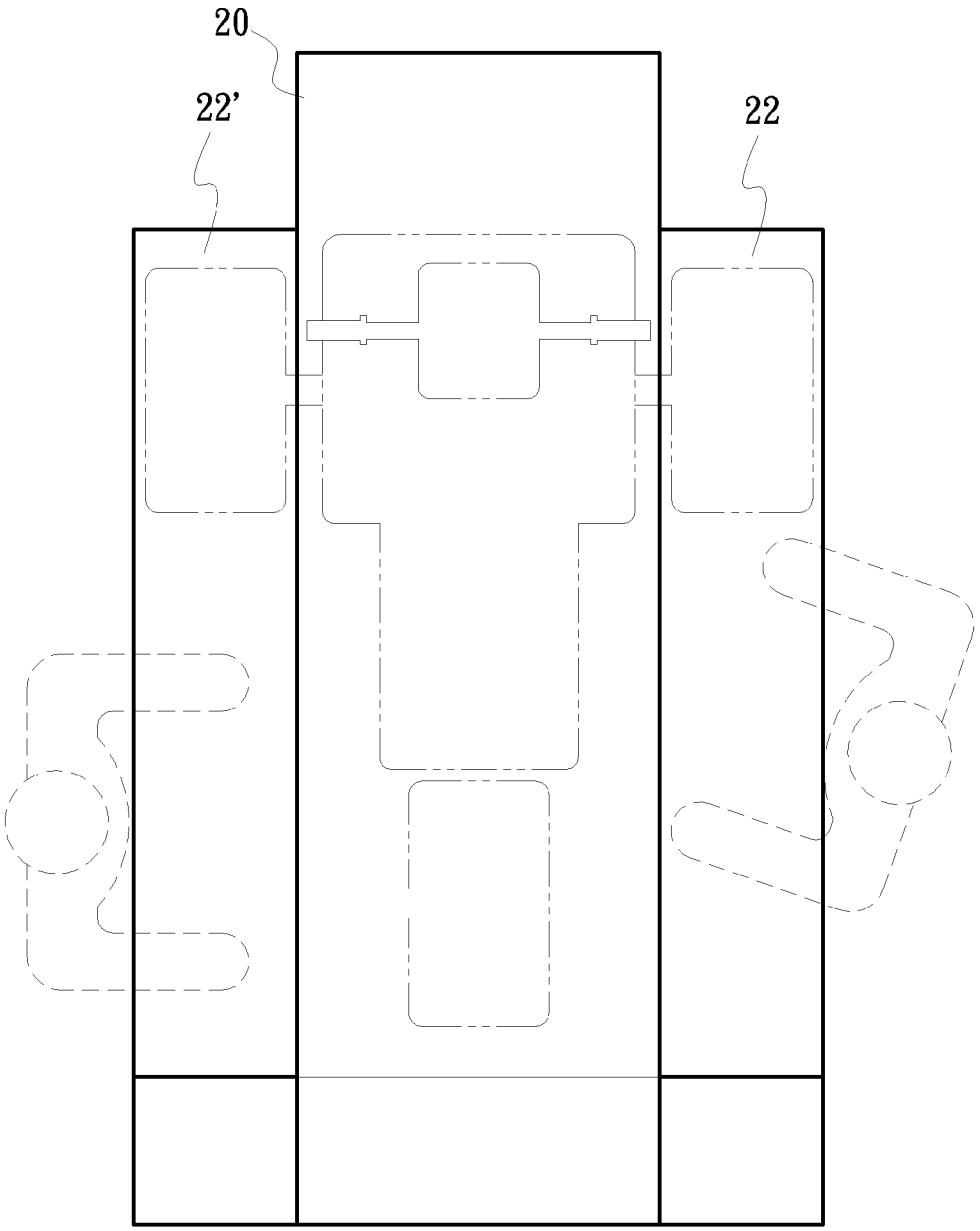
FIG. 1 is a schematic drawing of a conventional repairing station.
Figure 2:
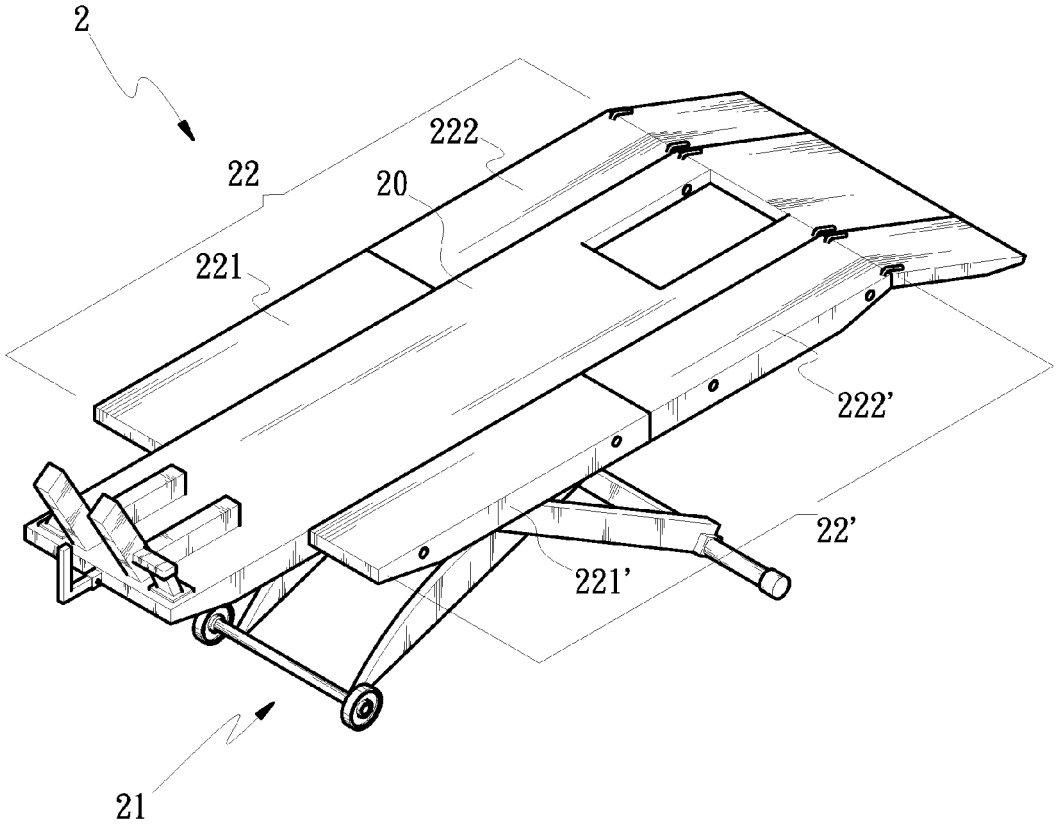
FIG. 2 is a perspective view of a workstation according to an embodiment of the present invention.
Figure 3:
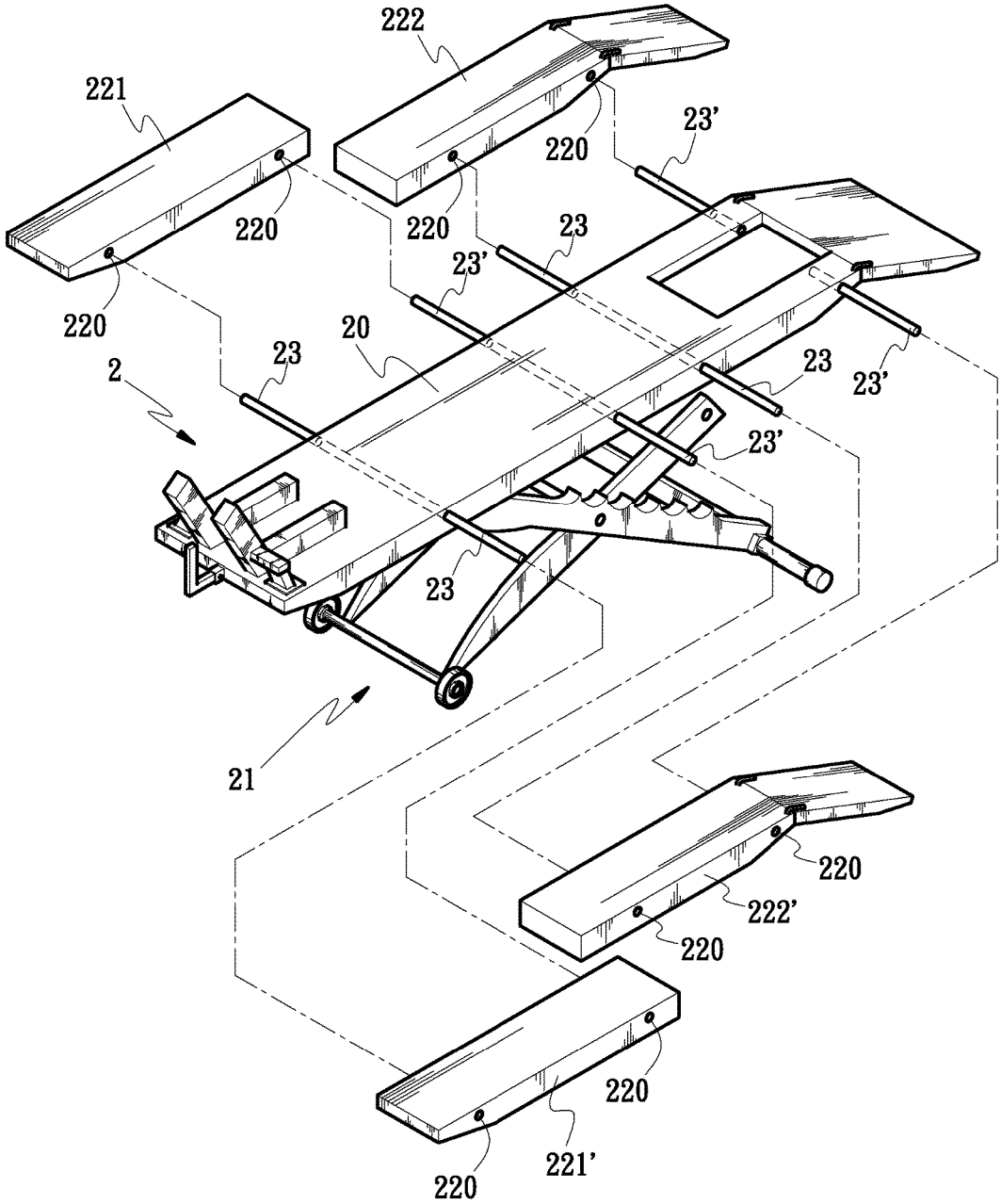
FIG. 3 is an exploded view of the workstation according to the embodiment of the present invention.

Please refer to FIG. 2 and FIG. 3. The workstation 2 is composed of a main board 20 and a supporting module 21. The supporting module 21 supports the workstation 2 and provides adjustable height for the workstation 2. The main board 20 further has at least two corresponding loading boards 22, 22' and a plurality of horizontal rods 23, 23' placed through the loading boards 22, 22'.

Furthermore, the loading board 22, 22' further includes a front loading board 221 (221') and a rear loading board 222 (222'), and the loading board also has a plurality of engaging apertures 220 on a corresponding side facing the main board 20. Every engaging aperture 220 is located corresponding to the horizontal rod 23, 23' such that the front and rear loading boards 221 (221'), 222 (222') can be engaged with the main board 20.

Figure 4:
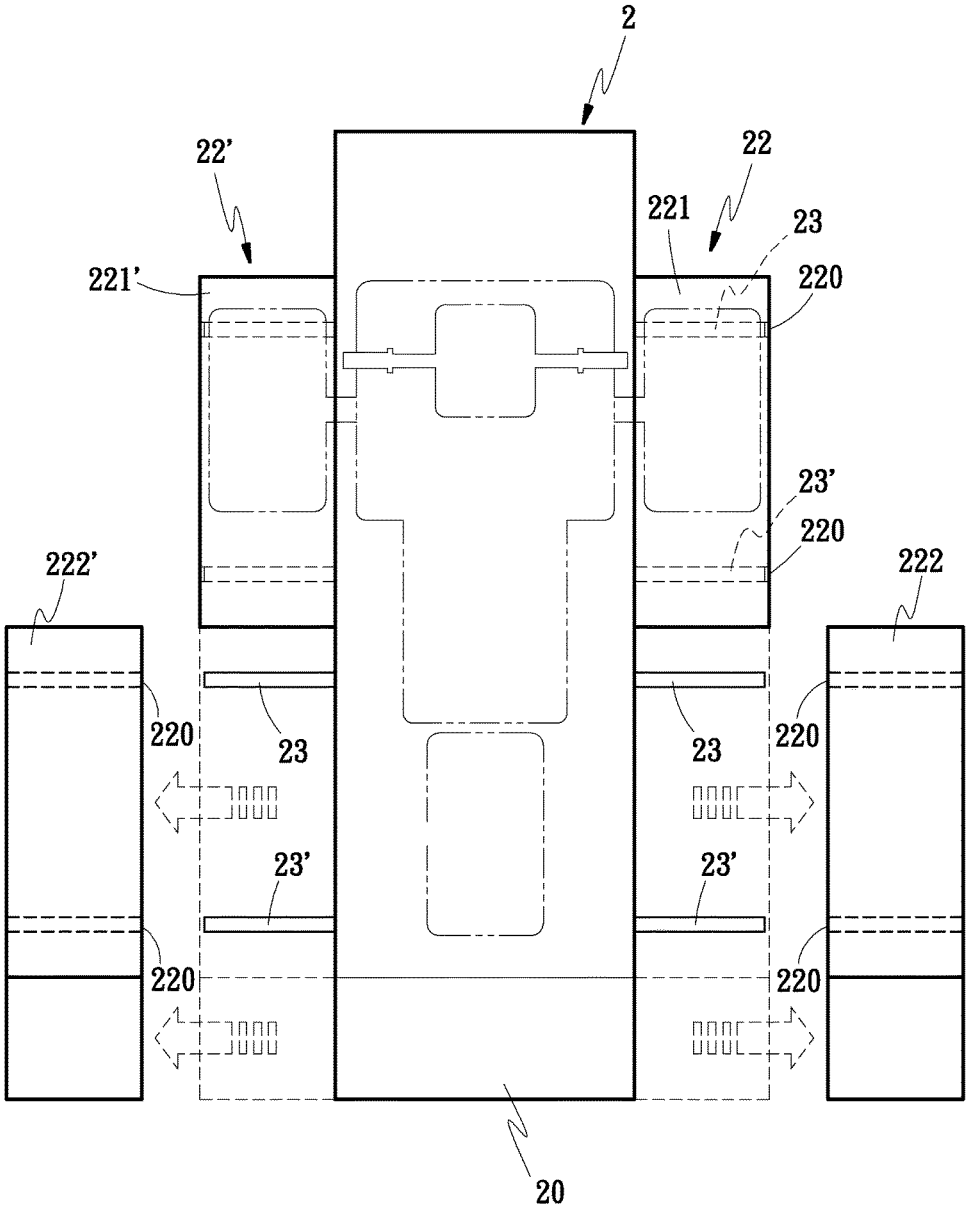
FIG. 4 is a schematic drawing of a loading board according to the embodiment of the present invention.
Figure 5:
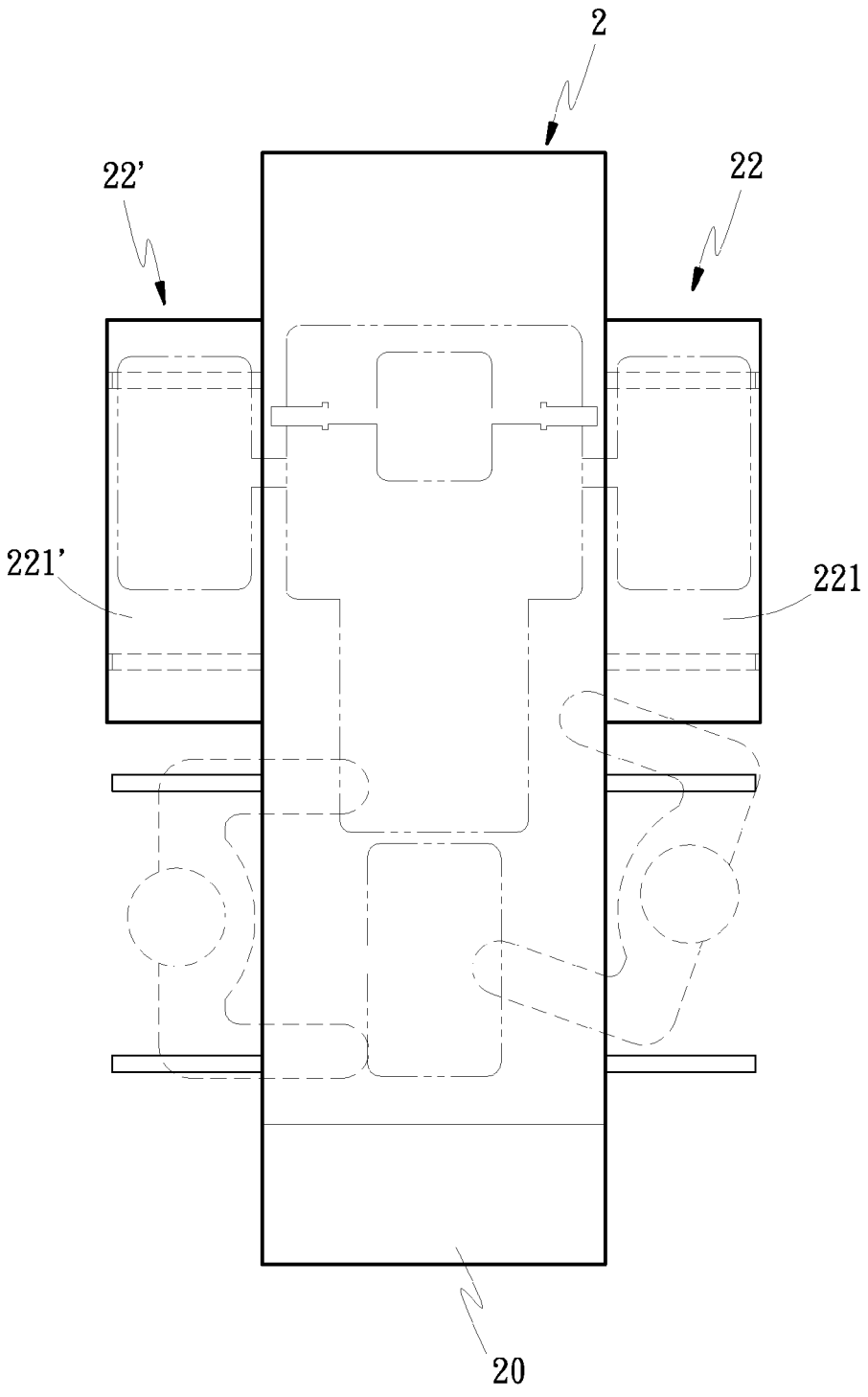
FIG. 5 shows when technicians working with the loading board according to the embodiment of the present invention.
Figure 6:
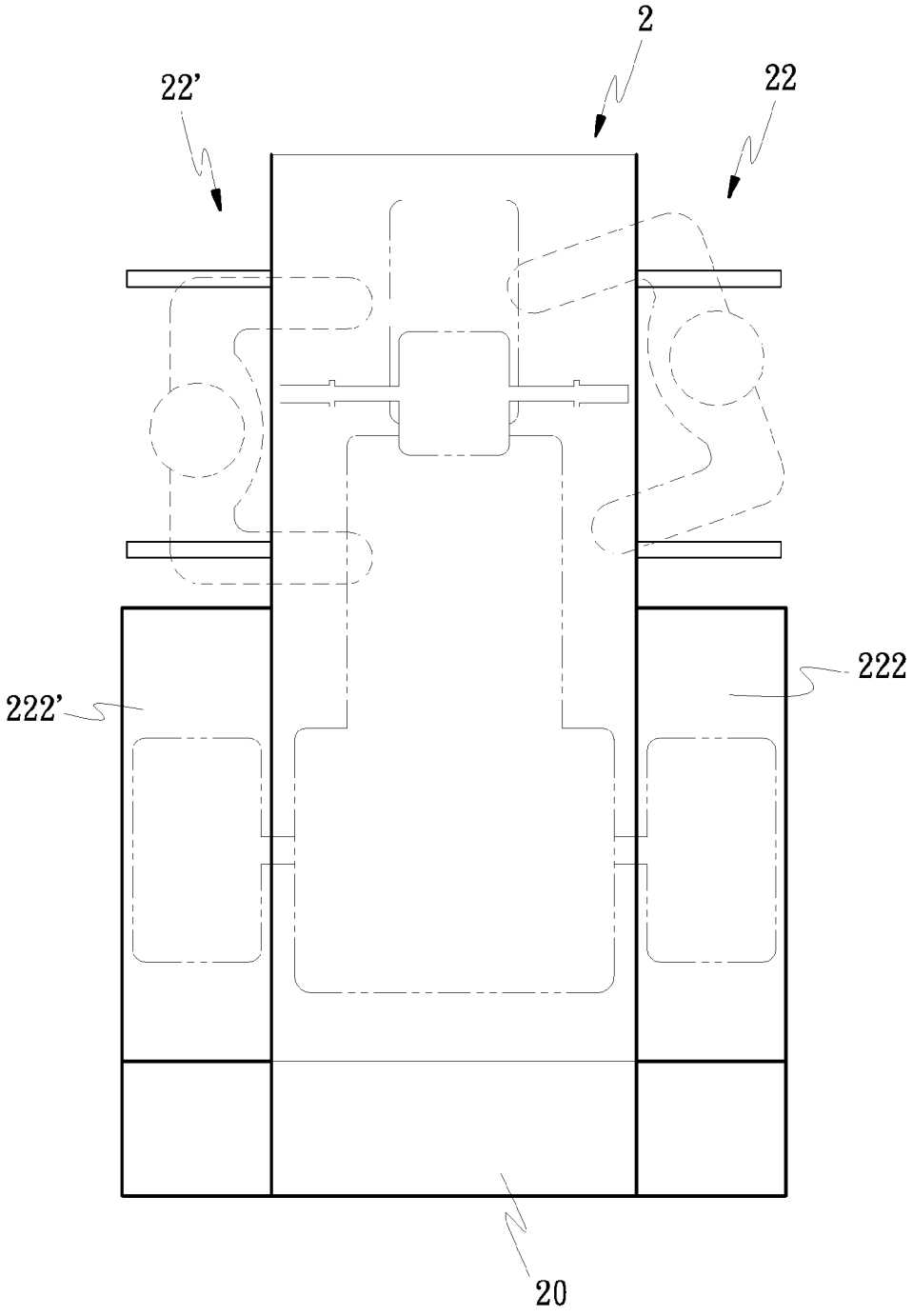
FIG. 6 also shows when technicians working with the loading board according to the embodiment of the present invention.

Please refer to FIG. 4 and FIG. 5. The main board 20 is combined with two opposite loading boards 22, 22 engaged with the plurality of horizontal rods 23, 23'. When the automobile vehicle is a two front wheels-one single rear wheel type, the technicians can remove the rear loading boards 222, 222' to get closer to the vehicle for repair or maintenance. As shown in FIG. 6, When the automobile vehicle is a one single front wheel-two rear wheels type, the technicians can remove the front loading boards 221, 221'.

Therefore, in the embodiment of present invention, the loading boards 22, 22' mounted at the two sides of the workstation respectively can be break into two sections, which can be suitable for the two front wheels-one single rear wheel type and the one single front wheel-two rear wheels type. With the easy assembly of the front loading board 221(221') or the rear loading board 222(222'), the technicians can work on different type of vehicles easily.

Figure 7:
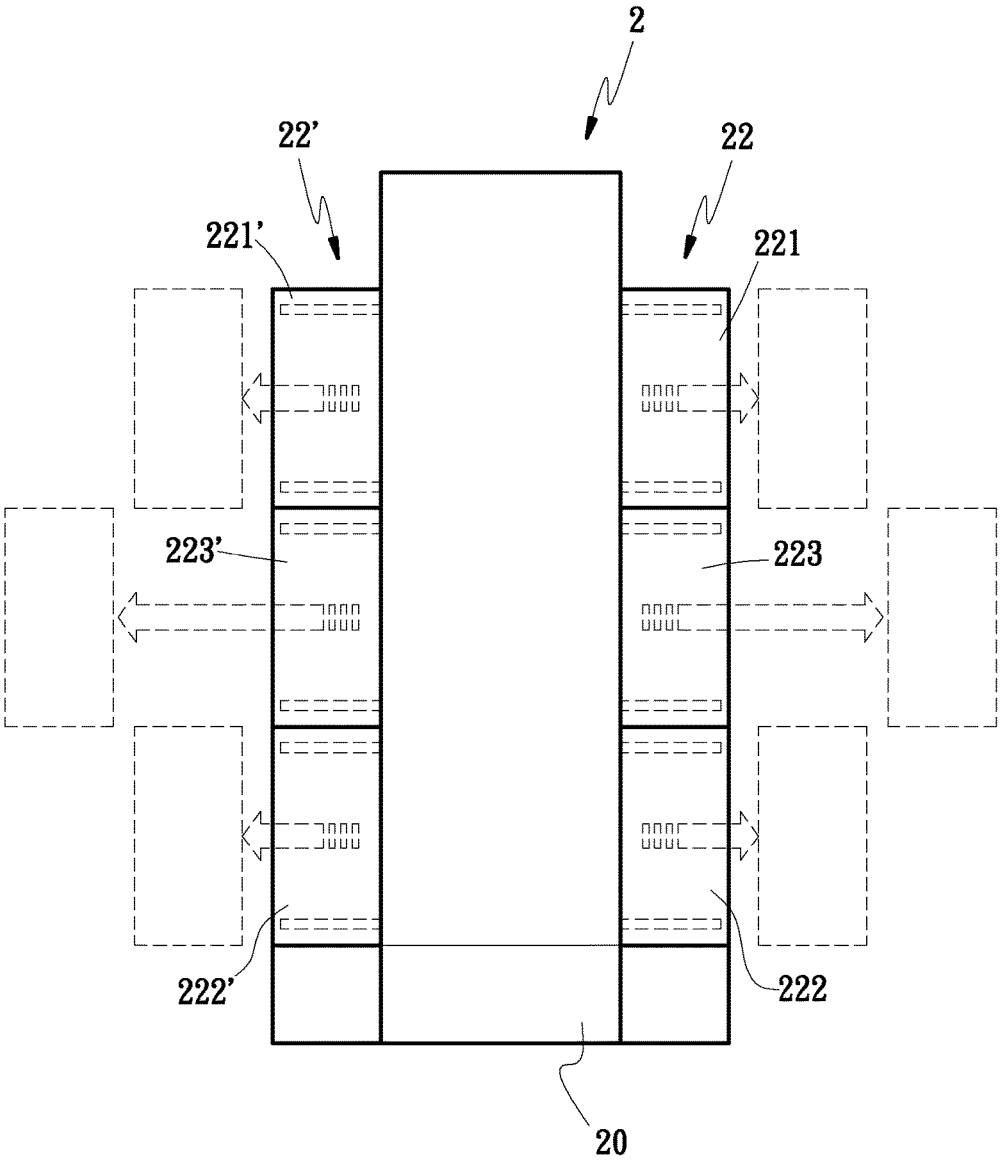
FIG. 7 is a schematic drawing of a loading board according to another embodiment of the present invention.

Please refer to FIG. 7. In another embodiment of the present invention, the loading boards 22, 22' of the main board 20 respectively include a front loading board 221 (221'), a rear loading board 222(222') and a middle loading board 223(223'). Therefore, the technicians can have various accesses for different type of vehicles.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A workstation with configurable leaves suitable for repairing or maintaining auto mobiles, comprising: a main board, a supporting module, at least two corresponding loading boards and a plurality of horizontal rods; characterized in that:

the loading board has multiple sections, and the loading board further has a plurality of engaging apertures at a corresponding side facing the main board, the number of the horizontal rod is equal to the numbers of the first and second engaging apertures.

2. The workstation with configurable leaves as claimed in claim 1, wherein the loading board further comprise a front loading board and a rear loading board.

3. The workstation with configurable leaves as claimed in claim 1, wherein the loading board further comprise a front loading board, a rear loading board and a middle loading board.

* * * * *